US005394721A

United States Patent [19]

Iwayama et al.

[11] Patent Number: 5,394,721

[45] Date of Patent: Mar. 7, 1995

[54] METHOD OF PRODUCING PERMALLOY CORES

[75] Inventors: Kenzo Iwayama, Kitakyushu; Tsunehiro Shimizu; Hidehiko Sumitomo, both of Hikari; Kunihide Takashima, Kitakyushu; Akira Amemura, Tokyo; Osamu Tanaka, Kitakyushu, all of Japan

[73] Assignee: Nippon Steel Corporation, Tokyo, Japan

[21] Appl. No.: 149,253

[22] Filed: Nov. 9, 1993

Related U.S. Application Data

[63] Continuation-in-part of Ser. No. 89,391, Jul. 9, 1993, abandoned, which is a continuation of Ser. No. 767,981, Sep. 30, 1991, abandoned.

[30] Foreign Application Priority Data

Mar. 10, 1990 [JP] Japan ..... 2-265803
Mar. 10, 1990 [JP] Japan ..... 2-265804

[51] Int. Cl.[6] ..... B21C 37/02; H01F 41/02
[52] U.S. Cl. ..... 72/46; 29/609
[58] Field of Search ..... 72/46; 29/605, 609; 336/196, 199

[56] References Cited

U.S. PATENT DOCUMENTS

| | | | |
|---|---|---|---|
| 2,394,047 | 2/1946 | Elsey et al. | 29/609 |
| 2,484,214 | 11/1949 | Ford et al. | 29/605 |
| 2,904,875 | 9/1959 | Trigg et al. | 29/609 |
| 2,966,725 | 1/1961 | Parker et al. | 29/609 |
| 3,364,057 | 1/1968 | Jackson | 72/47 |
| 3,378,626 | 4/1968 | Tucker | 29/605 |
| 3,545,078 | 12/1970 | Lightner et al. | 29/605 |

FOREIGN PATENT DOCUMENTS

| | | | |
|---|---|---|---|
| 63-121670 | 5/1988 | Japan . | |
| 63-202009 | 8/1988 | Japan | 29/609 |
| 583515 | 12/1977 | U.S.S.R. | 29/609 |

*Primary Examiner*—Lowell A. Larson
*Attorney, Agent, or Firm*—Kenyon & Kenyon

[57] ABSTRACT

A method of producing permalloy cores comprising the steps of coating at least one surface of permalloy strip with a slurry consisting of water containing 1 to 5 percent by weight of magnesium hydroxide ($Mg(OH)_2$) powder and the addition of one or more selected from a binder, a thickening agent and a defoaming agent and drying said coating, slitting the permalloy strip thus covered with a coating that when dry is 0.1 to 50 $\mu$m thick, more preferably 0.5 to 10 $\mu$m thick, and contains not less than 50 percent by weight $Mg(OH)_2$, and more preferably not less than 80 percent by weight $Mg(OH)_2$, as the main constituent, to a final width, or first to an intermediate width if necessary, winding or punching the final width strip to obtain wound or laminated punched cores, and subjecting the core materials to magnetization annealing.

7 Claims, No Drawings

METHOD OF PRODUCING PERMALLOY CORES

This application is a continuation-in-part of application Ser. No. 08/089,391, filed on Jul. 9, 1993, which is a continuation of application Ser. No. 07/767,981, filed on Sep. 30, 1991, (both now abandoned).

BACKGROUND OF THE INVENTION

1. Field of the Invention

This invention relates to a method of producing permalloy cores.

2. Description of the Prior Art

High permeability Ni—Fe magnetic alloys are widely used to form magnetic cores for light electrical equipment applications, and as a magnetic shielding material. The permalloy cores (soft magnetic Ni—Fe alloy cores) are produced by slitting sheet of a prescribed thickness to a final width, shaping the strips in accordance with the intended usage and following this by annealing.

Cores are divided broadly, by the processing method used, into wound cores and punched cores. Wound cores are produced by winding strips slit to a final width into cores having a prescribed inside and outside diameter. To produce punched cores, core pieces of a prescribed shape are punched or stamped out of strips slit to a final width. The usual shapes are that of an "E," "I" or "U," and the punched pieces are stacked to form stacking cores. The punched pieces may also then be subjected to bending and drawing for final application as magnetic shielding material or the like.

The permalloy cores thus formed are subjected to magnetization annealing at 900° to 1300° C. to impart the prescribed magnetic properties. The high temperature can cause the core pieces to seize together or to be burned at points of contact with the metal vessel. To prevent this, taking wound cores as an example, after being slit to the prescribed final width the core strips are immersed in a slurry of water and alumina ($Al_2O_3$) or magnesia (MgO), dried, wound and subjected to magnetization annealing. In the case of punched cores, after the core pieces have been punched out and the punching fluid removed, the cores are then coated with finely powdered alumina or magnesia or the like to prepare them for the annealing.

Thus, in the prior art methods the core pieces or core strips have to be subjected to complex, inefficient processes such as degreasing, annealing separator application and drying and the like. Moreover, in the case of wound cores the thickness of coatings can vary in a core and from core to core, which can readily lead to non-uniform pressure during the winding operation and degrade the magnetic properties of the end product. Also, because in the case of punched cores the size of the cores are usually small, in practice coating is a very complex procedure.

One solution to this problem has been proposed by JP-A-63-202009, in accordance with which a spray gun or supersonic wave means or the like is used to spray on a thin film of a colloid of boric acid, magnesium oxide (MgO), sodium silicate and water before the cores are formed, which, particularly in the case of punched cores, prevents the core pieces sticking together and therefore eliminates the conventional need to separate the core pieces one by one. With respect also to wound cores, there is a disclosure that should enable annealing efficiency to be increased by making it easier for hydrogen gas to enter between layers of the winding during the annealing.

While such methods are effective with respect to making it easier for punched core pieces to be separated and for enabling gas to be introduced and removed during annealing of wound cores, they still have the following basic drawbacks. Because both surfaces are coated with a thin film of a ceramic abrasive such as boric acid, MgO and sodium silicate, there tends to be considerable damage to punches and molds, which is very uneconomical with respect to the machine tools and in practice makes such methods difficult to use. With respect also to the spray method, it is difficult to apply the coating stably for an extended period which makes the securing of highly stable magnetic properties problematic.

SUMMARY OF THE INVENTION

An object of the present invention is to provide a method of efficiently manufacturing permalloy wound cores and punched cores with highly stable magnetic properties.

DETAILED DESCRIPTION OF THE INVENTION

The invention comprises two basic systems. The first system is a method of manufacturing wound cores and punched cores whereby the conventional complex processes can be omitted, said method comprising the application, prior to slitting the material to the final width, of an annealing separator coating that was found not to interfere with the subsequent slitting or punching. The second system is a method of manufacturing wound cores more efficiently by an entirely new process that utilizes the characteristics of a non-harmful coating.

The first system is a method of producing permalloy cores comprising the steps of coating at least one surface of permalloy strip with a slurry consisting of water containing 1 to 5 percent by weight of magnesium hydroxide ($Mg(OH)_2$) powder and the addition of one or more selected from a binder, a thickening agent and a defoaming agent and drying said coating, slitting the permalloy strip thus covered with a coating that when dry is 0.1 to 50 μm thick, more preferably 0.5 to 10 μm thick, and contains not less than 50 percent by weight $Mg(OH)_2$, and more preferably not less than 80 percent by weight $Mg(OH)_2$, as the main constituent, to a final width, or first to an intermediate width if necessary, winding or punching the final width strip to obtain wound or laminated punched cores, and subjecting the core materials to magnetization annealing.

In the prior art the annealing separator is applied after the core material has been slit to the final width. The features of the present invention, however, are that by the time the strips are slit to the final width they have already been coated with the annealing separator, that the coating does not interfere with the slitting process or subsequent punching or the like, and as a result it is possible to omit the degreasing, annealing separator application and other such complicated processes used in the prior art.

Any Ni—Fe alloy may be used for the permalloy of the method of this the invention. However, for manufacturing high permeability magnetic cores and magnetic shielding materials, it is preferable to use a Ni—Fe alloy having a nickel content within the range of 30 to 85 percent. Elements such as molybdenum, copper, silicon, chromium, manganese, boron, vanadium, niobium, and titanium may be added. There is no specific limitation on the thickness of the permalloy strip, which usually ranges from around 0.01 mm to 1.0 mm. There is no specific limitation on the width of the strip, other than that it should be of a width that enables it to be slit into a multiplicity of strips of the final width. In practice there is a wide range of widths from around 10 mm to 1200 mm, but widths generally range from 50 mm to 700 mm.

While an annealing separation coating may be applied to one or both surfaces of the strip, as wound and punched cores are usually stacked for annealing, it is preferable to apply the coating to both surfaces. A slurry is applied to the strip surface that when dried forms a coating that is 0.1 to 50 μm thick, and more preferably is 0.5 to 10 μm thick. A coating that is less than 0.1 μm thick will not provide adequate annealing separation properties, while a coating thickness of over 50 μm results in a major reduction in the space factor. A relatively thin coating may be used for thin permalloy sheet, but for thicker sheet a thick coating is preferable. For general purpose permalloy a coating thickness of 0.5 to 10 μm is generally preferable. At least 50 percent by weight, and more preferably at least 80 percent by weight, of the coating consists of $Mg(OH)_2$, with the remainder being residual water remaining from the drying step, and additives such as a binder and the like.

Experiments were undertaken with various ceramic coating materials to obtain a coating that would retain its annealing separator properties and not lead to any loss of workability with respect to the slitting and punching processes, from which it was found that the one solution was, as described above, to use $Mg(OH)_2$ as the main constituent, and that $Mg(OH)_2$ should comprise at least 50 percent by weight of the solid content of the annealing separator coating.

Some examples are listed in Table 1.

TABLE 1

| Sample | Type | Coated Yes/No | Composition | No. of punchings ($n_x$) ($n_x/n_A$) |
|---|---|---|---|---|
| A | Prior art | No | | 800,000 (= $n_A$) |
| B | Prior art | Yes | MgO 50% | 300 (0.004) |
| C | Prior art | Yes | $Al_2O_3$ 95% | <100 (<0.001) |
| D | Inventive | Yes | $Mg(OH)_2$ 95% | 790,000 (0.99) |
| E | Inventive | Yes | $Mg(OH)_2$ 92% | 770,000 (0.96) |
| F | Inventive | Yes | $Mg(OH)_2$ 80% | 760,000 (0.95) |
| G | Inventive | Yes | $Mg(OH)_2$ 80% | 770,000 (0.96) |
| H | Inventive | Yes | $Mg(OH)_2$ 75% | 690,000 (0.86) |
| I | Inventive | Yes | $Mg(OH)_2$ 60% | 670,000 (0.84) |
| J | Inventive | Yes | $Mg(OH)_2$ 50% | 630,000 (0.79) |
| K | Inventive | Yes | $Mg(OH)_2$ 50% | 610,000 (0.77) |
| L | Comparison | Yes | $Mg(OH)_2$ 45% | 530,000 (0.67) |
| M | Comparison | Yes | $Mg(OH)_2$ 30% | 450,000 (0.56) |

Table 1 shows the relationship between the number of punchings ($n_x$) at which the height of core burring reached 50 μm in the case of cores punched from 45 percent Ni—Fe permalloy sheet 0.35 mm thick, and the presence or absence of a coating, and coating type. Values in parentheses are an index of punchability obtained by dividing the $n_x$ of each sample by the number of punchings $n_A$ in accordance with a method of the prior art.

On the samples denoted by A, obtained by punching in accordance with the prior art without a coating, the height of the burring reached 50 μm at about 800,000 punchings ($n_x=n_A=800,000$). Samples B and C had a coating, but one prepared according to the prior art method in which the main component of the coating was MgO or $Al_2O_3$ and the rest water and the like, and it can be seen that punchability is much too poor to be practicable. The coating in this case was obtained based on the method of applying $Mg(OH)_2$ used in Example 1 described hereinbelow, except that MgO or $Al_2O_3$ was used in place of $Mg(OH)_2$. Samples D to M also each had a coating, again obtained based on the method of applying $Mg(OH)_2$ used in Example 1 described hereinbelow, with the coatings containing various amounts of $Mg(OH)_2$. Of these samples, D to K contained at least 50 percent $Mg(OH)_2$ in accordance with the method of the present invention, while with a $Mg(OH)_2$ content of less than 50 percent, L and M were outside the range of the invention. When $Mg(OH)_2$ is used for the coating, while there is some degradation in overall number of punchings compared to the prior art method in which no coating is used, the degree of this degradation is far less than the degree of degradation in the case of a MgO coating of sample B or an $Al_2O_3$ coating of sample C.

However, wear on the punch dies markedly increases the size of burrs, so that when the degree of burring reaches a specified level it becomes necessary to grind the dies. This means that the lower the number of punchings $n_x$, the more uneconomical the coating. On the other hand, as there is also an advantage in being able to omit steps that coating involves, when the total cost is taken into consideration, the point becomes the amount of degradation in the $n_x$ value that is permitted.

An overall examination from the various perspectives involved revealed that there was still a cost advantage even if the total number of punchings was allowed to decrease by 25 percent ($n_x/n_A=0.75$). As indicated by Table 1, while reducing the $Mg(OH)_2$ content of the coating reduced the $n_x/n_A$ value, providing the $Mg(OH)_2$ content is at least 50 percent the $n_x/n_A$ value will be at least 0.75. More particularly, with a $Mg(OH)_2$ content of at least 80 percent, the $n_x/n_A$ value will be at least 0.95, the coating material has major overall merit and very little demerit. Moreover, when a similar assessment was carried out with respect to slittability, the results obtained were more or less the same as those obtained with respect to punchability.

Based on the above facts, therefore, it can be seen that an annealing separator coating of $Mg(OH)_2$ does not cause marked wear of the machine tools, and that on an overall basis, with a $Mg(OH)_2$ content of at least 50 percent, even if there is a slight deterioration in punchability, in practice this can be ignored. The merits are particularly considerable when the content is 80 percent or more.

While it is not clear why a $Mg(OH)_2$ coating causes virtually no wear to machine tools, it is assumed that it is because $Mg(OH)_2$ has a good solid-lubricant effect provided by its crystalline structure that gives it a markedly less abrasive effect than that of coatings that use MgO, $Al_2O_3$ and the like.

The method of obtaining an annealing separator coating containing at least 50 percent by weight $Mg(OH)_2$ as the main component consists basically of the steps of applying and drying the prescribed solution. The coating is applied to the sheet surface in the form of a slurry consisting of water containing 1 to 5 percent by weight of magnesium hydroxide ($Mg(OH)_2$) powder and the addition of one or more selected from a binder, a thickening agent and a defoaming agent. Every effort should be made to avoid the admixture of ceramic powders such as MgO, $Al_2O_3$ and CaO that have abrasive properties. $Mg(OH)_2$ particle sizes range from the submicrometer level up to several tens micrometers, depending on purpose: to obtain a stable slurry, it is preferable to use smaller particles. It is difficult to obtain a uniform coating if the slurry has a $Mg(OH)_2$ content of less than 1 percent. On the other hand, if the content exceeds 5 percent there is a tendency for the $Mg(OH)_2$ to settle, and adding too much thickening agent to prevent such settling can cause an excessive increase in viscosity, thereby degrading the spreadability. Therefore a $Mg(OH)_2$ content of 1 to 5 percent has been specified.

The addition to the slurry of one or more selected from a binder, a thickening agent and a defoaming agent helps to improve adhesion to the permalloy, spreadability and other such properties. Adding binder is particularly useful for improving adhesion in cases where slitting, punching, bending and drawing operations exert a considerable frictional force on the surface of the strip that can cause a coating to peel. Preferably the binder should be one developed for ceramics applications with as few organic components as possible, and only the minimum amount required to ensure adhesion should be used. Adding a large amount of binder is undesirable as it increases slurry viscosity and degrades spreadability and, moreover, in the annealing process organic components present in the Ni—Fe can become included as impurities, degrading the magnetic properties.

There is no specific limitation on the composition of the binder. Any substance that provides the requisite function may be used as the main constituent such as, for example, a water-soluble emulsion type acrylic ester copolymer resin or ethylene-vinyl acetate copolymer resin. Generally, with a water-$Mg(OH)_2$ slurry or such a slurry that also contains a small amount of binder, solid $Mg(OH)_2$ in the slurry may settle, degrading the spreadability. To a considerable extent this can be remedied by adding a small amount of a thickening agent to enable the slurry to maintain the right viscosity. However, adding too much thickening agent can cause the slurry to gel, with a marked decrease in spreadability. An example of such a thickening agent is a substance having a smectite structure, but the thickening agent is not limited thereto, however, and may be any substance that provides the above effect. The addition of a binder can tend to cause foaming in the coating solution, reducing the spreadability. In most cases this can be solved by adding very small amounts of a commercial defoaming agent.

In the prior art, taking wound cores as an example, the coating is usually applied by the immersion in a water-MgO slurry of permalloy strips cut to a final width, followed by drying, but in many cases this immersion method does not provide a coating having a uniform prescribed thickness. A roll coater or bar coater can be used to apply a coating with a uniform thickness of 0.1–50 μm. Using a roll coater or bar coater is a known method of applying a uniform coating to thin sheets and foils, and is also well suited to the object of this invention. A roll coater is more effective for a sheet thickness of 0.05 to 1 mm, and a bar coater is more effective for a sheet thickness of 0.01 to 0.1 mm.

The slurry thus applied should be dried until there is no tackiness to the touch. In practice the coating is dried on a continuous basis by heating it for a short period at 100° to 400° C. in the atmosphere. A temperature range of between 100° and 400° C. is specified because drying at a temperature lower than 100° C. would take more time and would therefore be unproductive, while using a temperature higher than 400° C. can cause oxidation of the permalloy, degrading its magnetic properties, and can also cause decomposition of some of the $Mg(OH)_2$ in the coating which, by increasing the MgO, can increase the wear on the machine tools. While the duration of the drying varies according to the temperature, from several tens to several hundred seconds is enough at a low temperature (for permalloy sheet), and from several to several tens of seconds is enough at a high temperature.

The strips thus provided with a coating having $Mg(OH)_2$ as its main component are slit to a final width, after first being slit to an intermediate width, if required. Specifically, it is generally difficult to obtain good width precision when slitting wide sheet (1,000 mm, for example) into a number of narrow strips (5 mm, for example). One solution to this problem is to first slit wide sheet into strips of an intermediate width, and then slit these intermediate width strips to strips of the final width.

The strips thus slit to final width are wound to form wound cores or punched to form stacking cores, and these cores are then subjected to magnetization annealing. The same basic processes as those of the prior art may be used. However, compared with conventional winding methods, the excellent uniformity and adhesion of the coating of this invention enables strip thus coated to be wound under controlled pressure (tensile force) at a higher speed than that of a conventional winding method, and thereby offers advantages such as that it can be adapted to fully automated winding.

The foregoing description has been made with reference to the manufacture of wound cores and punched cores comprised mainly of stacked E and I pieces. Punched core pieces may also be subjected to bending, drawing and the like for end use as magnetic shielding materials. In this respect, the method of this invention causes virtually no hindrance to such bending and drawing operations, and may therefore be applied to the manufacture of such shielding materials which is based on an assumption that the materials will be subjected to slitting and punching.

In accordance with this invention there is basically no need to apply an annealing separator immediately prior to magnetization annealing, such as is the case with the prior art methods. If required, however, additional annealing separator may be applied when there is a problem caused by burning of edges which have been cut or punched and which therefore are not coated. Compared to the prior art procedure, this additional application of the annealing separator does of course involve far less work.

The foregoing description has been made with reference to a method of manufacturing wound or punched cores from permalloy strip, the characterizing features of which will now be summarized. With the method of this invention, in the case of wound cores, as the strips slit to the final width have already been coated with the annealing separator, they can be wound at high speed as soon as they are slit to the final width. In accordance with the prior art method, after being slit to width the strips are wound while being coated and dried, which limits the winding speed. Among other advantages of the method of this invention are that it results in excellent uniformity of coating thickness and winding pressure, providing better and more stable magnetic properties and less variation in the space factor.

JP-A-63-202009 discloses a method of applying an annealing separator prior to slitting to the final width, in practice there is a problem with this method in that the coating contains ceramic substances such as MgO which subject the machine tools to rapid wear, as shown by the number of punchings in the case of sample B in Table 1, increasing the cost at the slitting step. The method according to the present invention solves this basic problem and enables the prescribed object to be attained.

With respect next to punched cores, sheets that have already been coated with the annealing separator prior to slitting to final width, as in the case of this invention, can be subjected to the magnetization annealing step immediately following the punching or other process involved. In the prior art methods, E and I cores, for example, are degreased, coated and so forth after the core pieces are punched out, and as these core pieces are small, usually from 10 to several tens of millimeters across, and therefore difficult to handle, the effect of omitting such steps is considerable.

Another disclosure related to the technical field concerned will now be described, and its relationship to the method of this invention. U.S. Pat. No. 2,904,875 describes the application of a water-alcohol solution containing 5 to 15 $Mg(OH)_2$, bentonite and the like with the aim of forming an insulation resistance film on soft magnetic materials. The $Mg(OH)_2$ content differs from that of the present invention, the addition of an abrasive ceramic such as bentonite is an essential element, and 5 to 50 percent of the $Mg(OH)_2$ can be substituted by a metal oxide, metal silicate or metal phosphide, from which it is clear that it differs completely from the present invention in which non-loss of workability is a basic premise.

The above has been a description of the first system of this invention.

Next, the second system is a method of producing permalloy wound cores comprising the steps of coating at least one surface of permalloy strip with a slurry consisting of water containing 1 to 5 percent by weight of magnesium hydroxide ($Mg(OH)_2$) powder and the addition of one or more selected from a binder, a thickening agent and a defoaming agent and drying said coating, slitting the permalloy strip thus covered with a coating that when dry is 0.1 to 50 μm thick and contains not less than 50 percent by weight $Mg(OH)_2$ and more preferably not less than 80 percent by weight $Mg(OH)_2$ as the main constituent, to an intermediate width if necessary, forming the strip into a long cylindrical coil having a prescribed inside diameter and outside diameter that are the same as those of the target wound core product, cutting the cylindrical coil to obtain a plurality of product sizes of the prescribed final width (length, with respect to the cylinder) of the target wound core products, and subjecting the core materials to magnetization annealing.

This invention relates to a method for efficiently producing wound cores by an entirely new process which, as described in detail with reference to the first system, utilizes the characteristics of the coating as not adversely affecting the workability.

The composition, thickness and width of the permalloy strip, and the annealing separator coating solution composition, the surface to which it is applied, and the coating thickness and composition are the same as those of the first system and further description thereof will therefore be omitted. However, while basically the same coating thickness range as that of the first system may be used, depending on the method used to cut sections, described below, a slight increase in thickness tends to be preferable.

Strips coated with the annealing separator are wound so that they have the same inside and outside diameter as the final wound core products. This forms each strip into a long cylindrical coil. Efficiency is further improved if this winding is done on the same line on which the coating is applied and dried, following said operations, or the winding may be done on a different line.

Next, each long cylindrical coil is cut into sections of the required wound core width. With little variation in coating or winding pressure in the plurality of wound cores obtained from the same cylindrical coil, quality is better than that of conventional products which are individually coated and wound, and better also than that of wound cores obtained by the method of the first system, and this method also provides a major improvement in working efficiency.

While which cutting method is used depends on the thickness of the sheet, the size of the core and the intended application, effective, high-speed cutting can be achieved with a rotary fine-tooth cutter, saw-blade or laser-beam cutter, for example. The wound cores thus obtained are subjected to magnetization annealing. As the magnetization annealing procedure is the same as that used in the case of the method of the first system, further description thereof is hereby omitted. The same procedure used in the case of the first system may be used to apply annealing separator to edges exposed by the cutting process.

The method according to the second system of this invention allows permalloy wound cores of excellent quality to be efficiently produced.

The effectiveness of the present invention (first and second systems) will be explained with reference to the following examples.

EXAMPLE 1

Permalloy consisting of 79.3 percent nickel, 5.1 percent molybdenum, 0.003 percent carbon, 0.33 percent silicon, 0.9 percent manganese, 0.0004 percent sulfur, 0.002 percent phosphorus and 0.0007 percent nitrogen and the balance of iron and unavoidable impurities was cold-rolled to form strip 0.05 mm thick and 300 mm wide. After degreasing, the following method was used to form a coating 2 μm thick on both surfaces of this permalloy strip. The coating consisted of 85 percent $Mg(OH)_2$ with the balance of water and small amounts of carbon and nitrogen. 150 g of magnesium hydroxide with an average particle size of 0.1 μm was mixed into 5 liters of distilled water and the mixture was stirred vigorously for 30 minutes at room temperature. 70 cc of a binder consisting of a water-soluble emulsion type acrylic ester copolymer resin developed for ceramics applications was then added to the mixture, together with a small amount of a smectitic thickening agent and the mixture was stirred for a further 30 minutes. The 3 weight percent $Mg(OH)_2$ slurry thus produced was then applied to the strip with a rubber coater and then dried in a furnace at 150° C. to form permalloy sheet.

The strip thus coated was then slit into strips 15 mm wide, the width of a core, and a high-speed automatic coiling machine was then used to wind the strip into wound cores with 100 turns and an inside diameter of 50 mm.

Finely powdered alumina was sprinkled over the cut edges of the cores, which were then stacked in a furnace and subjected to magnetization annealing for 2 hours at 1150° C. in a stream of hydrogen. The wound cores thus obtained had an average inductance relative permeability at 1 kHz of 32,500. For comparison, in accordance with a conventional method, strip prepared from the same starting materials and not given a coating was slit, immersed in a tank of alcohol to which alumina was added and the mixture stirred, then dried and wound to form wound cores of the same size which exhibited an inductance relative permeability value of 25,000. In the case of the conventional method, non-uniformity of the coating thickness made it impossible to use a high-speed automatic winder to wind the strip. With the method of the present invention, however, the winding proceeded smoothly at the prescribed pressure with no problem. The slitting of the inventive strip provided with the coating also proceeded smoothly, and the degree of wear to the cutter teeth was virtually the same as that resulting from the slitting of non-coated material.

EXAMPLE 2

Two strips of permalloy each 0.25 mm thick and 400 mm wide were prepared by cold rolling permalloy consisting of 77.5 percent nickel, 3.4 percent copper, 4.4 percent molybdenum, 0.008 percent carbon, 0.2 percent silicon and 0.5 percent manganese and the balance of iron and unavoidable impurities. In accordance with a conventional method, one strip was slit into pieces 20 mm wide from which a continuous puncher was used to obtain E and I core pieces, which were degreased and coated with alumina powder having an average particle diameter of 3 μm.

The other strip was subjected to the same process applied to the inventive sample of Example 1 to thereby form a coating thereon, and the strip was then slit to form pieces 20 mm wide from which a continuous puncher was used to obtain E and I core pieces, as in the case of the conventional method. The slitting and punching machines showed no more than an ordinary degree of wear.

Both sets of core pieces thus obtained were annealed for 1 hour at 1,120° C. in a stream of hydrogen. A comparison of the time required from cold rolled strip to magnetization annealing showed a ratio of 1 in the case of the inventive method to 10 in the case of the conventional method. To evaluate the magnetic properties, the conventional and inventive methods were used to prepare square test specimens measuring 20 mm by 20 mm and with a center hole measuring 12 mm by 12 mm. After subjecting these specimens to the same magnetization annealing applied to the E and I cores, measurement of the magnetic properties showed an initial inductance relative permeability of 130,000±25,000 in the case of the conventional method, and 153,000±13,000 in the case of the inventive method.

This shows that compared to cores produced by the conventional method, the method of the present invention enables cores to be produced more quickly, and that the cores thus produced exhibit little variation.

EXAMPLE 3

Permalloy consisting of 77.0% nickel, 3.6% copper, 4.4% molybdenum, 0.007% carbon 0.4% silicon and 0.6% manganese and the balance of iron and unavoidable impurities was cold rolled to form strips A and B, each 350 mm wide and 0.10 mm thick. Strip A for processing by the conventional method was slit to a final width of 10 mm. After degreasing, the A strip and the 350-mm-wide B strip were both coated as described below.

The coating solution was prepared by adding 220 g of magnesium hydroxide having an average particle size of 0.5 μm to 5 liters of distilled water and stirring the mixture vigorously. Small amounts of a binder and a thickening agent were also added, and the mixture was again stirred. The slurry thus obtained contained about 4 percent by weight of $Mg(OH)_2$.

The A strip was immersed in this slurry and was then dried at 150° C. A steel bar coater was used to apply the slurry to both surfaces of the B strip, and was then dried at 300° C. The coating contained 90 percent by weight of $Mg(OH)_2$ and in each case had an average thickness of about 4 μm. Strip A exhibited variation in coating thickness in the widthwise direction, with the thickness at the center portion being 3 to 5 μm while the thickness at the edges was 4 to 10 μm. On the other hand, the thickness of strip B was uniformly 3 to 4 μm whatever the location. Strip B was slit to a width of 10 mm and both strips A and B were wound to form cores having 50 turns and an inside diameter of 40 mm, and these cores were subjected to magnetization annealing for 30 minutes at 1150° C. Cores made from strip A had an outside diameter of 55 to 60 mm, while cores made from strip B had an outside diameter of 53 to 56 mm. Strip A cores had an inductance relative permeability at 1 kHz of 26,500±8,000, while that of the strip B cores was 30,300±5,000. Thus, it can be seen that wound cores produced by the application of the method of the present invention have good, stable magnetic properties and an excellent space factor.

EXAMPLE 4

The same starting material used in Example 3 was used to form strip 350 mm wide which was coated with an annealing separator using the same process applied to strip B, and this strip was then formed into a 50-turn core with an inside diameter of 40 mm. A high speed cutter was then used to cut this into sections each 10 mm wide to obtain wound cores of the same size as those of Example 3, and these cores were then subjected to the same magnetization annealing. The outside diameter at this time was 55 to 56 mm, and the inductance relative permeability at 1 kHz was 31,000±3,000. Thus, it can be seen that wound cores produced by the application of the method of the present invention have good, stable magnetic properties and an excellent space factor.

What is claimed is:

1. A method of producing permalloy cores comprising the steps of: coating at least one surface of permalloy strip with a slurry consisting of water containing 1 to 5 percent by weight of magnesium hydroxide ($Mg(OH)_2$) powder and the addition of one or more selected from a binder, a thickening agent and a defoaming agent and drying said coating, slitting the permalloy strip thus covered with a coating that when dry is 0.1 to 50 μm thick, more preferably 0.5 to 10 μm thick, and contains not less than 50 percent by weight $Mg(OH)_2$, and more preferably not less than 80 percent by weight $Mg(OH)_2$, as the main constituent, to a final width, or first to an intermediate width if necessary, winding or punching the final width strip to obtain wound or laminated punched cores, and subjecting the core materials to magnetization annealing.

2. The method according to claim 1, wherein the punched strip is subjected to bending or drawing.

3. The method according to claim 1, wherein annealing is carried out after additional application of annealing separator to the surface of edges subjected to final slitting, or to the surface of punched edges.

4. The method according to claim 1, wherein a roll coater or bar coater is used to apply an annealing separator coating slurry to permalloy strip and the coated strip is dried by heating it to a temperature of between 100° and 400° C.

5. A method of producing permalloy cores comprising the steps of: coating at least one surface of permalloy strip with a slurry consisting of water containing 1 to 5 percent by weight of magnesium hydroxide ($Mg(OH)_2$) powder and the addition of one or more selected from a binder, a thickening agent and a defoaming agent and drying said coating, slitting the permalloy strip thus covered with a coating that when dry is 0.1 to 50 μm thick and contains not less than 50 percent by weight of $Mg(OH)_2$ and more preferably not less than 80 percent by weight of $Mg(OH)_2$ as the main constituent, to an intermediate width if necessary, forming the strip into a long cylindrical coil having a prescribed inside diameter and outside diameter that are the same as those of the target wound core product, cutting the cylindrical coil to obtain a plurality of product sizes of the prescribed final width (length, with respect to the cylinder) of the target wound core products, and subjecting the core materials to magnetization annealing.

6. The method according to claim 5, wherein annealing is carried out after additional application of annealing separator to the surface of edges of wound cores slit to a final width.

7. The method according to claim 5, wherein a roll coater or bar coater is used to apply an annealing separator coating slurry to permalloy strip and the coated strip is dried by heating it to a temperature of between 100° and 400° C.

* * * * *